US008736446B2

(12) United States Patent
Hayashide et al.

(10) Patent No.: US 8,736,446 B2
(45) Date of Patent: May 27, 2014

(54) SECURITY SENSOR SYSTEM

(75) Inventors: Koji Hayashide, Otsu (JP); Katsutoshi Tatsuoka, Otsu (JP)

(73) Assignee: Optex Co., Ltd., Shiga (JP)

( * ) Notice: Subject to any disclaimer, the term of this patent is extended or adjusted under 35 U.S.C. 154(b) by 327 days.

(21) Appl. No.: 13/143,441

(22) PCT Filed: Jan. 6, 2009

(86) PCT No.: PCT/JP2009/000018

§ 371 (c)(1),
(2), (4) Date: Jul. 6, 2011

(87) PCT Pub. No.: WO2010/079527

PCT Pub. Date: Jul. 15, 2010

(65) Prior Publication Data

US 2011/0273292 A1 Nov. 10, 2011

(51) Int. Cl.
*G08B 13/18* (2006.01)
*G08B 13/00* (2006.01)

(52) U.S. Cl.
USPC ..... 340/555; 340/545.1; 340/545.3; 340/565; 340/539.1; 340/541

(58) Field of Classification Search
USPC ..... 340/541, 517, 521, 539.1, 545.1, 545.3, 340/545.4, 555, 556, 565; 250/200, 201, 250/336, 336.1
See application file for complete search history.

(56) References Cited

U.S. PATENT DOCUMENTS 4,679,034 A * 7/1987 Kamada ..... 340/567
5,942,981 A 8/1999 Kackman
6,317,040 B1 11/2001 Ikeda
6,885,301 B2 * 4/2005 Park ..... 340/541
7,385,496 B2 6/2008 Ogino et al.
7,511,615 B2 * 3/2009 Shahar ..... 340/555
7,650,144 B2 1/2010 Nakamura et al.
2004/0075551 A1 4/2004 Marino
2005/0160325 A1 7/2005 Ogino et al.
2006/0209176 A1 9/2006 Nakamura et al.

FOREIGN PATENT DOCUMENTS

DE 202006003401 U1 7/2006
JP 2000-099835 A 4/2000
JP 2001-056887 A 2/2001
JP 2004-334423 A 11/2004
JP 2005-284356 A 10/2005
JP 2007-179555 A 7/2007
JP 2007-200046 A 8/2007
WO 03/088174 A1 10/2003

OTHER PUBLICATIONS

European Search Report for Application No. 09837418.4-2215/2387012; May 22, 2012.

(Continued)

*Primary Examiner* — Hung T Nguyen
(74) *Attorney, Agent, or Firm* — Sughrue Mion, PLLC

(57) ABSTRACT

Since a sensor signal intermitted on the basis of a sensor signal including an abnormality detection signal, detected as a result of a persistence of an abnormal condition of a security sensor, is generated and an intermitted output signal in dependence on an intermitted sensor signal input is transmitted from a wireless transmitter 17 to a receiver 18, a condition in which the intermitted output signal can be transmitted from the wireless transmitter 17 to the receiver 18 can be retained even though the wireless transmitter 17 is of a type capable of transmitting an output signal in the form of, for example, one pulse on the basis of the signal input, and it is therefore possible for the side of the receiver 18 to recognize assuredly the persistence of the abnormal condition.

6 Claims, 8 Drawing Sheets

(56) References Cited

OTHER PUBLICATIONS

Notification of Transmittal of Translation of The International Preliminary Report on Patentability; PCT/JP2009/000018; Aug. 25, 2011.

Office Action for Application No. 2010-545619; Nov. 20, 2012.

Decision of Rejection issued Jun. 11, 2013 in corresponding Japanese Patent Application No. 2010-545619.

Notification of Reasons for Rejection dated Dec. 10, 2013, issued in Japanese Patent Application No. 2010-545619.

* cited by examiner

SECURITY SENSOR SYSTEM

BACKGROUND OF THE INVENTION

1. Field of the Invention

The present invention relates to a security sensor system including a security sensor, made up of an object detecting subunit for detecting an object and a wireless transmitter, and a receiver for receiving a signal transmitted wireless from the wireless transmitter.

2. Description of Related Art

As shown in FIG. 7, the conventional security sensor system has been known, which includes a security sensor assembly 101, made up of a light projecting unit 102 for projecting infrared rays of light (IR) within a warning area and a light receiving unit 103 for receiving the projected infrared rays of light (IR), both of which are secured to respective supports such as, for example, mounting poles or outer walls of a building, and a receiver 118 disposed, for example, indoor and connected with the security sensor assembly 101 through a connecting cable W. In this conventional security sensor system, when an object intercepts the infrared rays of light within the warning area, an object detecting subunit 110 of the light receiving unit 103 detects the Object and then outputs a warning signal based on this, which warning signal is subsequently received by the receiver 118 through the connecting cable W. The security sensor system has also been known in the art, which includes a PIR (Passive Infrared Ray) security sensor, made up of only a light receiving unit for detecting infrared rays of light emanating from an object, and a receiver connected with this security sensor through a connecting cable. (See, for example, the Patent Document 1 listed below.)

This system generally operates under a security mode during the nighttime or the absence from home, but under a non-security mode during the daytime or the presence at home without performing any warning output (alarming or warning by way of sounds, light or signals) of a human body detection even though a signal input occurs from the sensor. Accordingly, the receiver receives the warning signal, outputted during the security mode, and provides a warning output, but no warning output occurs even though it receives the warning signal outputted during the non-security mode. It has, however, been found that where the security sensor assembly 101 of the AIR (Active Infrared Ray) system and the receiver 118 are connected with each other through the connecting cable, as shown in FIG. 7, so that when during the non-security mode an intercepting object such as, for example, a vehicle is placed within the 10 detection area, the warning signal is continuously (in a hold state) outputted to the receiver, connected with it through the connecting cable, during the interception by the intercepting object as shown in chart (a) of FIG. 8. When the non-security mode is subsequently switched over to the security mode, the receiver 118 receives this signal and the presence of an abnormality can be ascertained.

Even where during the non-security mode such an abnormality detection signal indicative of the detection of an abnormal condition of the sensor as, for example, a tamper signal, which is continuously outputted from the tamper signal output subunit 113, shown in FIG. 7, as a result of a tamper switch being switched on or off upon removal of a sensor covering in an attempt to conduct any interference, is outputted, the abnormality can be ascertained when the non-security mode is switched over to the security mode.

[Patent Document 1] JP Laid-open Patent Publication No. 2001-56887

DISCLOSURE OF THE INVENTION

In the meantime, in recent years, in place of the wired connection between the security sensor assembly and the receiver, for the purpose of minimizing the labor required in wiring to thereby reduce the cost, it is increasing to incorporate a wireless transmitter in the security sensor assembly so that wireless transmission may take place with the receiver. In such case, even though the sensor signal of the warning signal or the abnormality detection signal are continuously outputted during the non-security mode and the security mode as shown in chart (a) of FIG. 8, in the general purpose wireless transmitter an set-up (or a set-down) thereof is detected based on such sensor signal input and, although not limited to one pulse (shot) signal, a signal of a specification, in which the output is not continued, is transmitted during the non-security mode as shown in chart (b) of FIG. 8. As shown in chart (a) of FIG. 8, when the non-security mode is subsequently switched over to the security mode, unlike the case with the previously described wired connection, the signal is not continuously (in a hold state) transmitted to the receiver, but only one-pulse signal is transmitted during the non-security mode, and, therefore, the receiver is unable to receive such signal during the security mode and, hence, it will occur that the persistence of the abnormal condition cannot be ascertained.

The present invention has been devised to substantially eliminate the foregoing problems and inconveniences and is intended to provide a security sensor system of a type capable of recognize the persistence of an abnormal condition in a receiver in the event that an abnormality detection signal indicative of the persistence of the abnormal condition of the security sensor is transmitted from a wireless transmitter to the receiver.

In order to accomplish the foregoing object of the present invention, there is provided a security sensor system which includes security sensor assembly including an object detecting subunit for detecting an object, a controller and a wireless transmitter for transmitting an output signal based on a signal input, and a receiver for receiving an output signal transmitted from the wireless transmitter. The controller includes an intermitted signal generating section for generating, based on a sensor signal including an abnormality detection signal, which is a signal associated with a sensor and which is detected as a result of persistence of an abnormal condition of the sensor, a sensor signal in which such sensor signal is intermitted, and is operable to perform a control of inputting the intermitted sensor signal to the wireless transmitter and then transmitting the intermitted output signal based on such signal input. It is to be noted that the term "sensor signal" referred to above and hereinafter is intended to mean a signal associated with a sensor, which includes a warning signal based on an object detection signal indicative of an object detected persistently and an abnormality detection signal detected as a result of the persistence of an abnormal condition of a sensor such as, for example, a tamper signal, a low buttery signal, anti-masking signal and adverse environment signal.

According to the above described construction, since the sensor signal intermitted on the basis of the sensor signal including the abnormality detection signal indicative of the abnormal condition of the sensor detected continuously is generated by the intermitted signal generating section and the intermitted output signal in proportion to the intermitted sensor signal input is transmitted from the wireless transmitter to the receiver, a condition in which the intermitted output signal can be transmitted from the wireless transmitter to the receiver can be retained even though the wireless transmitter is of a type capable of transmitting an output signal in the form of, for example, one pulse on the basis of the signal input, and it is therefore possible for the side of the receiver to recognize assuredly the persistence of the abnormal condition.

In a preferred embodiment of the present invention, the receiver may include a mode switching section for switching over to one of a security mode and a non-security mode such that the receiver is operable to output no warning output even when receiving the output signal transmitted from the wireless transmitter during the non-security mode, but to output the warning signal when receiving the output signal transmitted from the wireless transmitter during the security mode. Accordingly, since where during the non-security mode the sensor signal including the abnormality detection signal is persistently outputted, the condition in which the intermitted output signal is transmitted to the receiver is maintained, the receiver receives the intermitted output signal, when the security mode is assumed, to thereby perform a warning output and, therefore, it is possible to assuredly recognize the persistence of the abnormal condition.

In another preferred embodiment of the present invention, the controller also may include a transmission signal switching section for switching the sensor signal, inputted to the wireless transmitter, over to one of the intermitted sensor signal and a non-intermitted sensor signal and may be operable to cause the wireless transmitter to transmit an intermitted output signal or a non-intermitted, ordinary output signal. Accordingly, in the event that there is no need to maintain the condition in which the intermitted sensor signal is generated and then such intermitted signal is transmitted from the wireless transmitter to the receiver, the ordinary output signal is transmitted to achieve a reduction in power consumption and increase of the lifetime of the wireless transmitter.

In a further preferred embodiment of the present invention, the security sensor may have at least one battery mounted thereon and is driven by a direct current electric power, in which case the abnormality detection signal includes a low battery signal detected as a result of a persistence of a low battery condition. Accordingly, it is possible to assuredly recognize the persistence of the abnormal condition of the low battery.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF PREFERRED EMBODIMENTS

Figure 1:
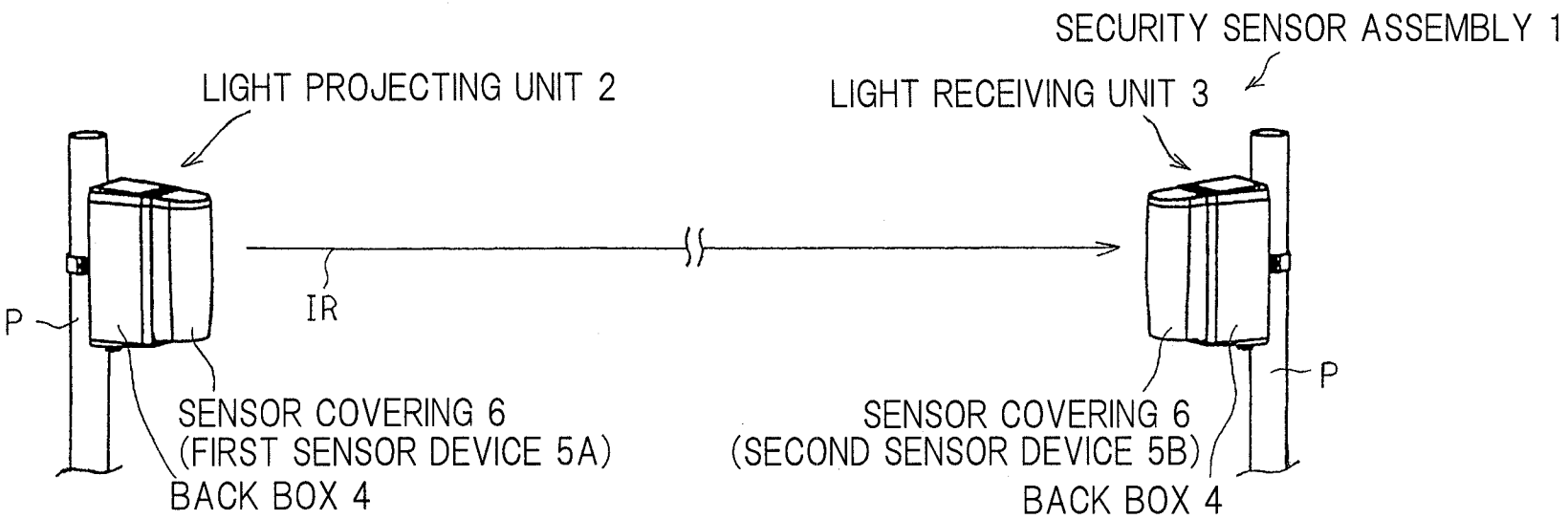
FIG. 1 is a schematic perspective view showing a security sensor to which the present invention pertains.
Figure 2:
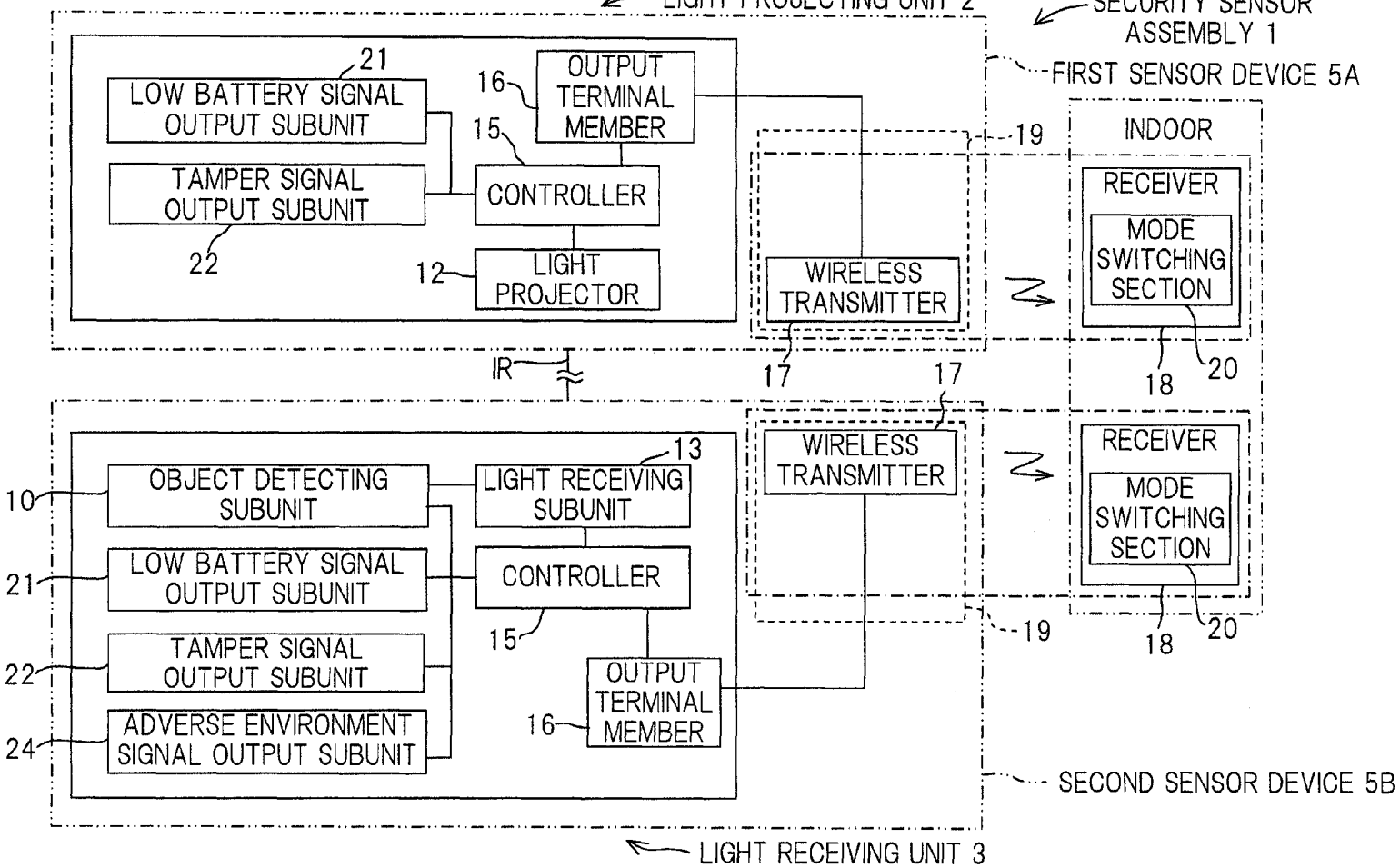
FIG. 2 is a circuit block diagram showing the security sensor system according to a first preferred embodiment of the present invention.

Preferred embodiments of the present invention will now be described with reference to the accompanying drawings. FIG. 1 illustrates a schematic perspective view of the security sensor to which the present invention pertains and FIG. 2 is a circuit block diagram showing a security sensor system according to a first preferred embodiment of the present invention. As shown in FIG. 1, a security sensor assembly 1 is of an AIR (Active Infrared Ray) sensor including a light projecting unit 2 and a light receiving assembly 3 that are mounted on respective stationary support members such as, for example, support poles P in face-to-face relation to each other and so designed that while an infrared beam is projected from the light projecting unit 2 onto a warning area defined, the light receiving assembly 3 receives a portion of the infrared beam projected from the light projecting unit 3 and then reflected from an object entering in the warning area.

Each of the light projecting unit 2 and the light receiving assembly 3 is made up of a unit housing comprised of a back box 4 and a sensor covering 6. A first sensor device 5A is accommodated within the sensor covering 6 of the light projecting unit 2 while a second sensor device 5B is accommodated within the sensor covering 6 of the light receiving assembly 3. However, the back box 4 of each of the light projecting and receiving assemblies 2 and 3 accommodates therein a wireless transmitter 17 and an electric power source such as, for example, at least one battery as will be described in detail later.

Referring now to FIG. 2, the illustrated security sensor system includes the security sensor assembly 1 of the structure described above, in which each of the light projecting unit 2 and the light receiving assembly 3 includes, inter alia, a controller 15, an output terminal member 16, a wireless transmitter 17 for transmitting an output signal wireless in dependence on a signal input, and a receiver 18 installed indoor for receiving an output signal transmitted wireless from the wireless transmitter 17. It is, however, to be noted that only the light receiving assembly 3 is additionally provided with an object detecting subunit 10 for detecting an object entering in the warning area.

The receiver 18 employed in the illustrated security sensor system has a mode switching section 20 operable to enable the respective assembly 2 and 3 to be set in one of a security mode, which is generally assumed during the nighttime or the absence from home, and a non-security mode which is generally assumed during the daytime or the presence at home, and the receiver 18 does not provide a warning output even, that is, does not perform a warning operation when receiving an output signal transmitted from the wireless transmitter 17 during the non-security mode, but does provide the warning signal when receiving an output signal transmitted from the wireless transmitter 17 during the security mode. Regarding the detection of an object entering the warning area, it is quite often that only when such object detection is required, for example, during the nighttime, the mode is switched from the non-security mode to the security mode, but regarding, for example, the tamper and/or the low battery condition, the system is set in 24 hour security mode.

As best shown in FIG. 2, the light projecting unit 2 of the security sensor assembly 1 is so designed that the first sensor device 5A employed therein may include a light projector 12 such as, for example, a light projecting element, a controller 15, an output terminal member 16 and the wireless transmitter 17. Although not shown, this second sensor device 5A also includes a power source such as, for example, at least a battery, a battery saving switch and a tamper switch and further includes a low battery signal output subunit 21 and a tamper signal output subunit 22 for outputting a tamper signal.

The low battery output subunit 21 is operable, when the stored voltage of the battery in the light projecting unit 2 decreases down to a value lower than a predetermined voltage, to output an abnormality detection signal in the form of a low battery signal indicative of a low battery condition occurring in the light projecting unit 2. In order to minimize the power consumption and also to minimize labors required to perform a wiring work, the security sensor assembly 1 generally makes use of the battery and is driven by a direct current voltage furnished thereby. When the sensor assembly 5A is removed from the sensor covering 6 in an attempt to conduct an interference such as, for example, a tampering of the security sensor system, the tamper switch is switched on or off and the tamper signal output subunit 22 is then activated to provide an output signal in the form of a tamper signal indicative of the persistency of such an abnormality condition. The conduct to interfere referred to above includes an act to perform a wiring process so that no signal will be outputted as a result of, for example, removal of the sensor covering 6.

The light receiving unit 3 of the security sensor assembly 1 is so designed that the second sensor device 5B employed therein may include a light receiving subunit 13 such as, for example, a light receiving element and an object detecting subunit 10 for detecting an object entering in the warning area and also includes, in a manner similar to the light projecting unit 2, a controller 15, an output terminal member 16, and a wireless transmitter 17. Although not shown, this second sensor device 5B yet includes, in a manner similar to the light projecting unit 2, a power source such as, for example, at least a battery, a battery saving switch, an intermittent switch and a tamper switch, and furthermore includes an adverse environment signal output subunit 24 in addition to a low battery signal output subunit 21 and a taper signal output subunit 22.

The low battery output subunit 21 and the tamper signal output subunit 22 of the light receiving unit 3 output the respective signals in a manner similar to those in the light projecting unit 2. When within the warning area the infrared rays of light are intercepted, the object detecting subunit 10 of the light receiving unit 3 outputs an object detection signal successively during the period in which such infrared rays of light are intercepted. The controller 15 outputs a warning signal based on this objection detection signal. The adverse environment signal output subunit 24 outputs an abnormality signal of an adverse environment signal in the event that when the level of the infrared rays of light received is lowered by the effect of, for example, fog or frost, for example, in the event that the level of the infrared rays of light received is lower than a predetermined adverse environment detection level and the condition that a warning output level has not been reached continues for a predetermined time.

For the wireless transmitter 17, used in each of the light transmitting unit 2 and the light receiving unit 3, and the receiver 18 installed indoor, a general purpose two-way transmission module is employed. In such case, the light projecting unit and the light receiving unit 3 make use of respective storage spaces 19 for accommodating, for example, two general purpose wireless transmitters 17. Although in the instance as shown, the receiver 18 is employed for each of the wireless transmitters 17, the use of the only one receiver 18 may be made if such receiver 18 has a channeling function capable of discriminating the outputs.

Figure 3:
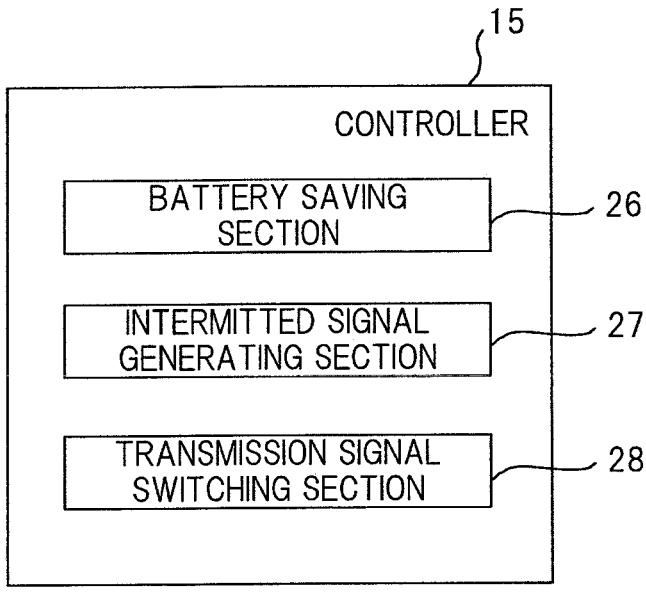
FIG. 3 is a block diagram showing a control unit employed in the security sensor system shown in FIG. 2.

The controller 15 is operable to control each of the units 2, 3 and includes, as best shown in FIG. 3, a battery saving section 26, an intermitted signal generating section 27 and a transmission signal switching section 28. The battery saving section 26 performs a battery saving operation when the battery saving switch is switched on in order that consumption of the battery can be reduced when a sensor signal such as, for example, an abnormality detection signal is to be outputted as a intermitted sensor signal.

The intermitted signal generating section 27 generates the sensor signal pertaining to a signal associated with a sensor, which is a sensor signal containing an abnormality detection signal detected as a result of persistence of an abnormality condition occurring in the sensor is intermitted on the basis of the sensor signal containing the abnormality detection signal. In the instance as shown, the sensor signal intermitted at predetermined intervals in dependence on the abnormality detection signal is generated from each of the various abnormality detection signals by section of the execution of a software program accommodated beforehand in the controller 15.

It is to be noted that in place of the execution of the software program, the intermitted signal generating section 27 may be constructed with a hardware circuit incorporated in the controller 15 for generating the intermitted sensor signal. In such case, such circuit has to be so designed and so configured that, for example, when which one of the abnormality detection signals the sensor signal is determined, pulses are outputted routinely at the predetermined intervals in dependence on the various abnormality detection signals with the use of a timer IC or a counter IC. Also, the use may be made of an integrating circuit to output those pulses at the predetermined intervals by section of charging and discharging of a capacitor.

The controller 15 of the light receiving unit 3 generates a warning signal, based on the object detection signal indicative of the continuous detection of the object by section of the object detecting subunit 10, generates the intermitted warning signal (sensor signal) by section of the intermitted signal generating section 27, causes those signals to be inputted to the wireless transmitter 17 through the output terminal member 16, and transmits the intermitted signal, based on this signal input, from the wireless transmitter 17 to the receiver 18.

Even where the wireless transmitter 17 makes use of the general purpose produce capable of transmitting an output signal comprised of one pulse based on the signal input from the intermitted signal generating section 27, the output signals are transmitted based on the input of the intermitted sensor signal, and, therefore, the intermitted output signal can be transmitted. By way of example, the warning signal is outputted at intervals of one minute. Abnormality detection signals (sensor signals) such as a low battery signal, a tamper signal and an adverse environment signal in each of those units are also transmitted as an intermitted output signal in a similar manner. By way of example, the low battery signal is outputted one output at intervals of five minutes and the adverse environment signal is outputted one output at intervals of one minute.

The transmission signal switching section 28 referred to above is operable to switch the sensor signal to be inputted to the wireless transmitter 17 over to one of the intermitted signal and the not intermitted sensor signal. Then a control to transmit one of the intermitted output signal or an ordinary output signal, which is not intermitted, from the wireless transmitter 17 is performed by the controller 15. Reduction in power consumption and increase of the lifetime of the wireless transmitter 17 can be attained when the ordinary output signal is transmitted, where there is no need to generate the intermitted signal and then to maintain such a condition that the intermitted output signal are transmitted from the wireless transmitter 17 to the receiver 18, such as occurring when it is installed at a place where there is no possibility of sustaining the abnormality detection signal or when the wireless transmitter 17 is employed in the form of a wireless transmitter having a function of providing the intermitted output. In the instance now under discussion, by section of the software execution in a manner similar to the above, the switching takes place based on a switching command input to the controller 15. It is to be noted that the use of a transmission signal switching switch within the controller 15 may be made so that the switching can be attained by section of a hardware circuit.

Figure 4:
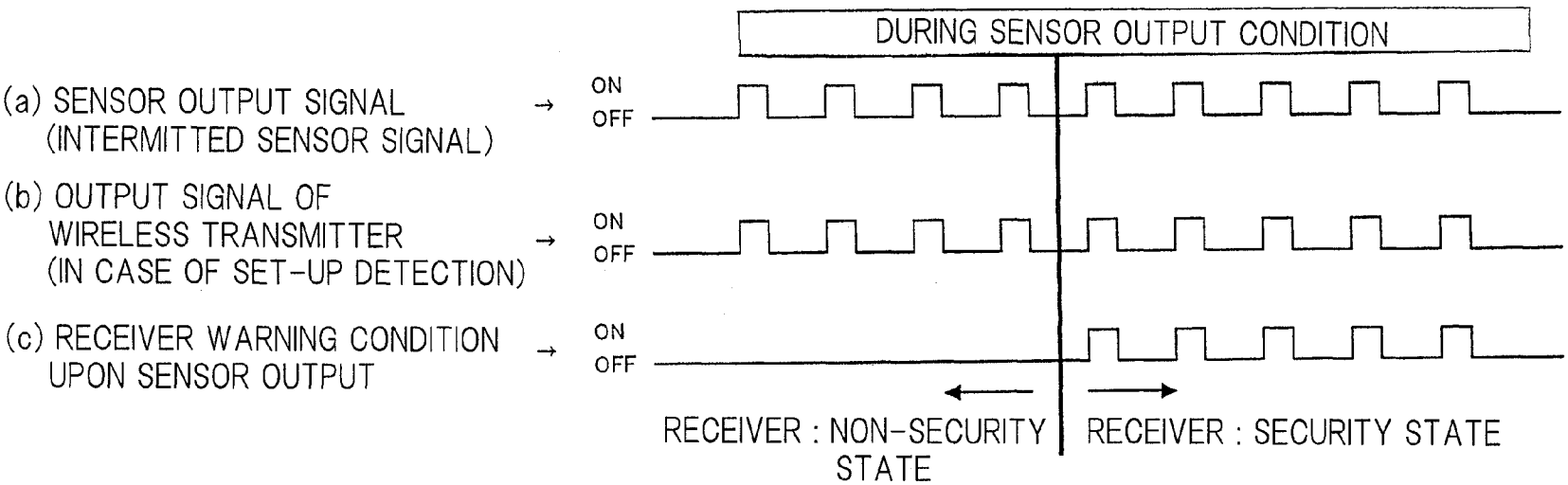
FIG. 4 is a timing chart showing the operation to generate an intermitted detection signal.

FIG. 4 illustrates a timing chart showing the operation when the intermitted sensor signal is generated from the sensor signal. Chart (a) of FIG. 4 represents the sensor output signal (intermitted sensor signal) generated by the intermitted signal generating section 27. Chart (b) of FIG. 4 represents a condition in which the intermitted sensor signal is inputted to the wireless transmitter 17 and the intermitted output signal proportional to the signal input (output signal) is transmitted from the wireless transmitter 17 to the receiver 18 as a result of detection of, for example, a pulse set-up of this signal. Chart (c) of FIG. 4 represents a condition in which, although no warning output take place even when during the system being set under the non-security mode the receiver 18 receives the intermitted sensor signal, the warning output takes place when the receiver 18 generates the warning output when it receives a signal indicative of the change from the non-security mode to the security mode.

Accordingly, in the event that during the non-security mode the sensor signal including the abnormality detection signal is continuously outputted, the intermitted output signal maintains the condition in which it is transmitted to the receiver 18 shown in FIG. 2 and, therefore, when the mode changes to the security mode, the receiver 18 can perform the warning output in response to the intermitted output signal received thereby and, hence can assuredly recognize that the abnormal condition still continues.

Figure 5A:
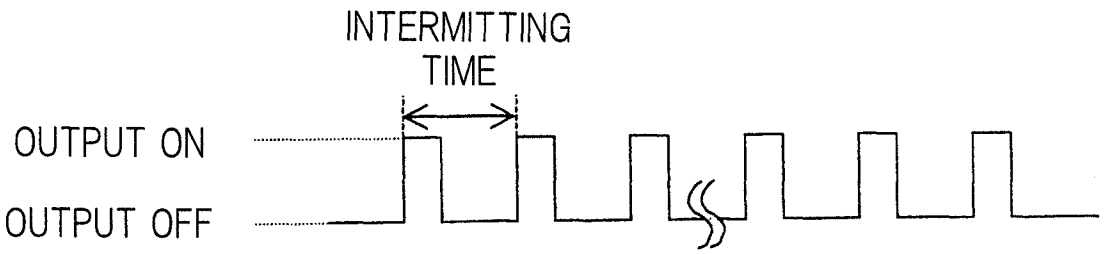
FIGS. 5A and 5B are timing charts showing the battery saving operation, respectively.
Figure 5B:
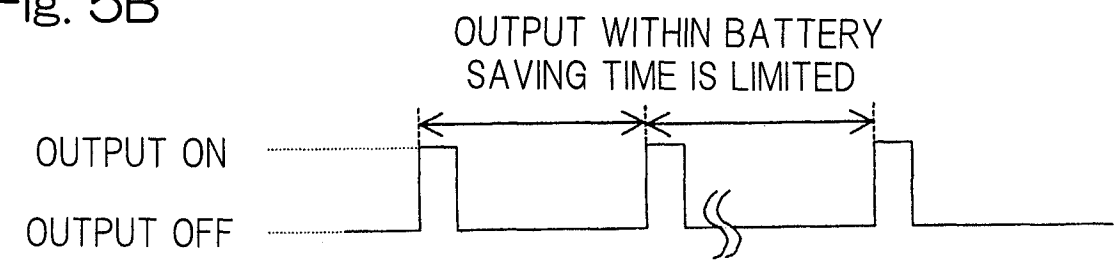

Also, when as shown in FIG. 5A, when in each of the units 2, 3 the intermitted signal generating section 27 shown in FIG. 3 is caused to output the sensor signal intermitted at the intervals of the predetermined time, the consumption of the stored voltage in the battery increases. For this reason, as shown in FIG. 5B, when by the control of the battery saving section 26, the intermitting interval (time) of the intermitted sensor signal is increased by the intermitted signal generating section 27 to a value of, for example, twice, outputting within the battery saving time can be restricted to achieve the saving of the battery. Accordingly, the consumption of the stored voltage in the battery can be reduced.

As hereinabove described, according to the present invention, by the intermitted signal generating section 27, the sensor signal intermitted on the basis of the sensor signal including the abnormality detection signal detected persistently of the abnormal condition of the sensor can be generated and, hence, the intermitted output signal in proportional to the intermitted sensor signal input can be transmitted to the receiver 18 from the wireless transmitter 17. Therefore, even if the wireless transmitter 17 is employed in the form of the general purpose product capable of transmitting the output signal in the form of one pulse on the basis on the signal input, or in the form of the general purpose produce of a different system, the condition in which the intermitted output signal is transmitted from the wireless transmitter 17 to the receiver 18 can be maintained regardless of what type the wireless transmitter 17 employed is, and it is possible to assuredly recognize that the abnormal condition is sustained on the side of the receiver 18.

Figure 6:
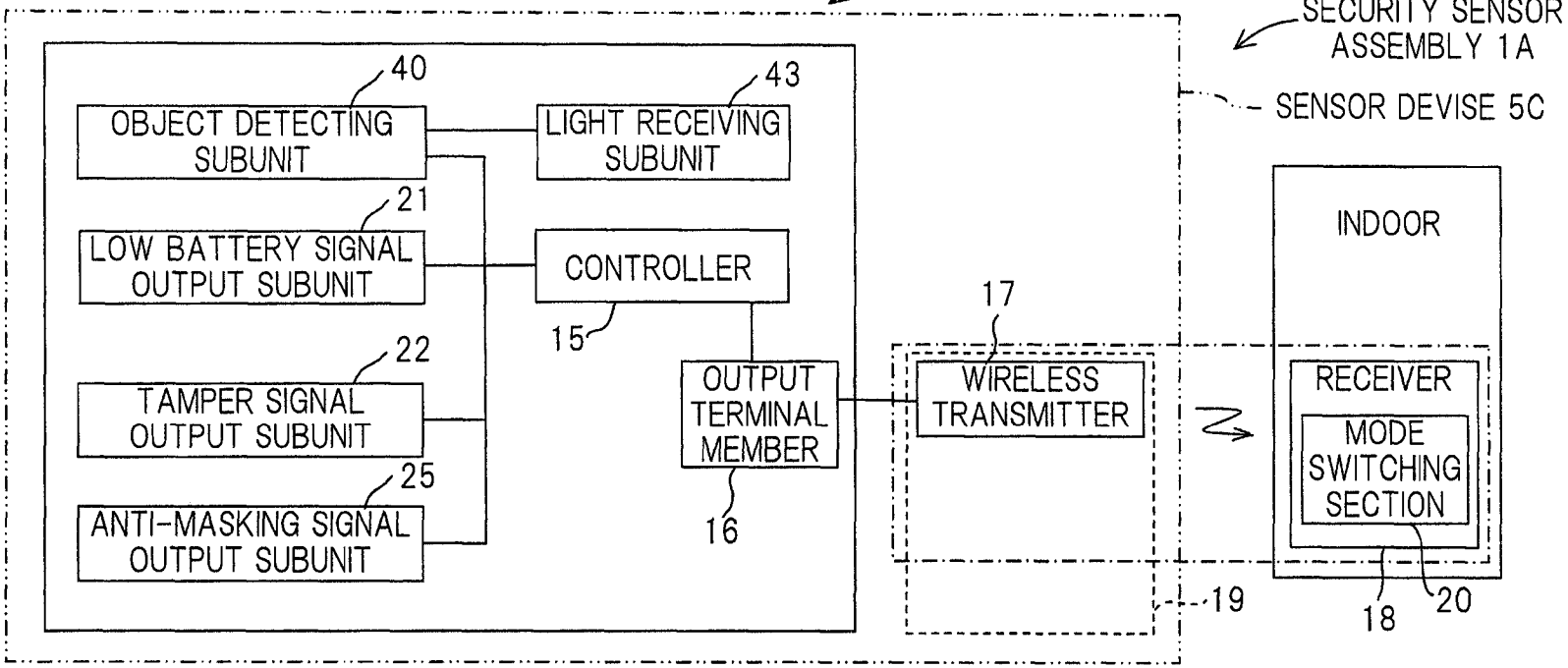
FIG. 6 is a circuit block diagram showing the security sensor system according to a second preferred embodiment of the present invention.
Figure 7:
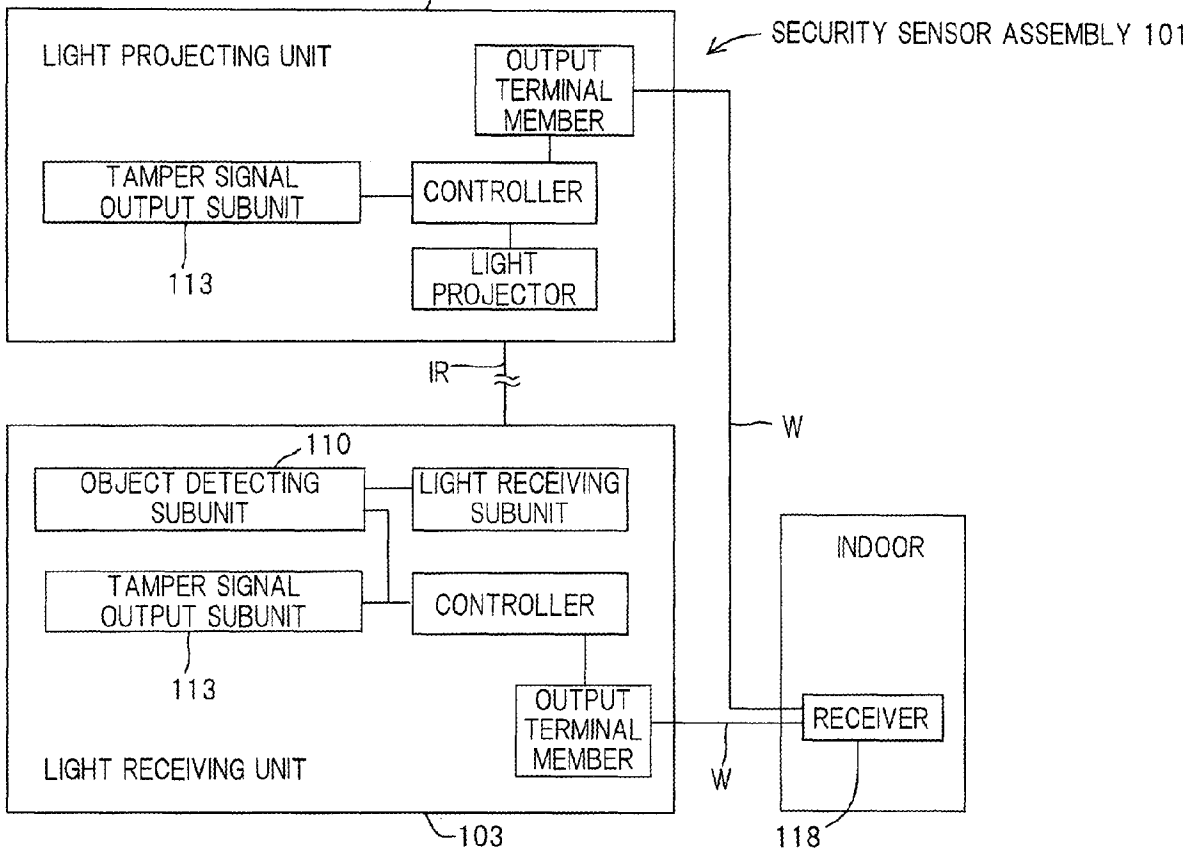
Fig. 7 Prior Art
FIG. 7 is a circuit block diagram showing the conventional security sensor system.
Figure 8:
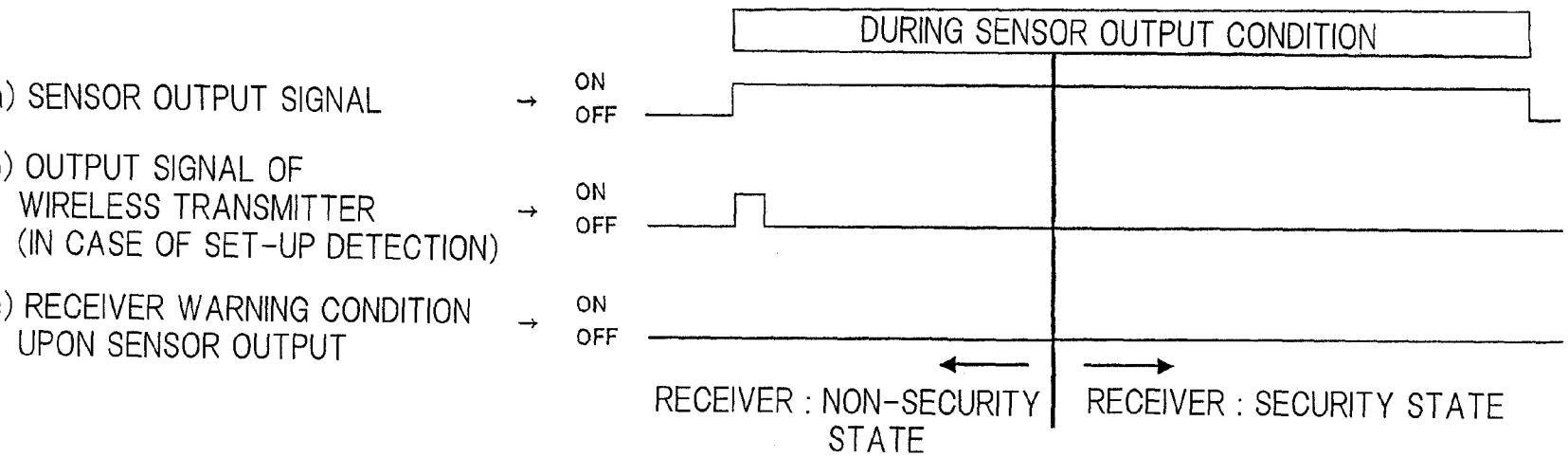
FIG. 8 is a timing chart showing the operation of the conventional security sensor.

FIG. 6 illustrates a second preferred embodiment of the present invention. In contrast to the previously described first embodiment of the present invention in which the security sensor assembly employed therein is of the AIR (Active Infrared Ray) sensor made up of the light projecting unit and the light receiving unit, the second embodiment of the present invention makes use of the security sensor assembly 1A in the form of the PIR (Passive Infrared Ray) sensor including a light receiving unit 33 itself. The light receiving unit 33 is made up of a back box 4 and a sensor covering 6 (See FIG. 1.) and a sensor device 5C is accommodated within the back box 4. The PIR light receiving unit 33 is different in function and structure from the AIR light receiving unit and is not necessary limited to one example of the appearance such as the light receiving unit 3 shown in FIG. 1.

The light receiving unit 33 of the security sensor assembly 1A is so designed that the sensor device 5C may include, in addition to a light receiver 43 such as, for example, a pyroelectric element and an object detecting subunit 40, a controller 15, an output terminal member 16, a wireless transmitter 17, a battery (not shown), a battery saving switch (not shown) and a tamper switch (not shown) and also includes a low battery signal output subunit 21, a tamper signal output subunit 22 and an anti-masking signal output subunit 25. The act of interference in this tampering is, for example, a masking made within the sensor covering 6 so that when, for example, the sensor covering 6 is removed during the non-security mode, no detection may be made of the object during the security mode. In the instance now under discussion, the object detecting subunit 40 is of a type capable of outputting the object detection signal consisting of, for example, one pulse upon detection of the object and since it does not output the object detection signal persistently, no intermitted sensor signal is generated. Not only can the wireless transmitter 17 and the receiver 18 be employed in the form of general purpose two-way transmission modules, but the other structural features than those described above are similar to those shown and described in connection with the first embodiment of the present invention.

The low battery signal output subunit 21 and the tamper signal output unit 22 output the respective signals in a manner similar to those in the previously described first embodiment. The anti-masking signal output subunit 25 outputs an abnormality detection signal in the form of an anti-masking signal in the event that the presence of a shielding matter such as, for example, a length of tape or paper in the vicinity of a front surface of a lens is detected, which presence is caused as a result of a lens surface is obstructedly intercepted by the shielding matter attached to the lens surface externally of the sensor covering 6 or the lens surface is sprayed with a paint material from outside.

And, by the intermitted signal generating section 27 best shown in FIG. 3, based on the abnormality detection signal (sensor signal) indicative of the persistence of the abnormal condition of the sensor such as the low battery signal, the tamper signal and the anti-masking signal, the sensor signal, which are the sensor signals intermitted, and the condition in which the intermitted output signal based on them can be transmitted from the wireless transmitter 17 to the receiver 18 can be retained, in a manner similar to the previously described first embodiment.

In this way, even in the second embodiment of the present invention, even though as is the case with the first embodiment, the wireless transmitter 17 is employed in the form of the previously discussed general purpose product capable of transmitting the output signal in the form of, for example, only one pulse based on the signal input, the condition in which the intermitted output signal can be transmitted from the wireless transmitter 17 to the receiver 18 can be held and it is accordingly possible to assuredly recognized on the part of the receiver 18 that the abnormal condition is sustained.

It is to be noted that although in any one of the foregoing embodiments of the present invention, reference has been made to the use of the sensor signal, in which the sensor signal such as the object detection signal, provided for by the AIR sensor, forming a part of the security sensor assembly, and the various abnormality detection signals, the present invention is not necessarily limited thereto and any other output signal such as an output signal from, for example, a magnet switch may be intermitted.

It is also to be noted that although in any one of the foregoing embodiments of the present invention, the security sensor assembly has the battery mounted thereon and is driven by the direct current electric power, the present invention is not necessarily limited thereto and the power supply lines or the like may be connected by section of a wiring system and such an output signal as the intermitted sensor signal may be connected to the wireless transmitter 17 and is then transmitted to the receiver 18.

Furthermore, although in any one of the foregoing embodiments of the present invention, the use has been made of the transmission signal switching section 28 for switching over to one of the intermitted sensor signal and the sensor signal not intermitted, this transmission signal switching section 28 may be dispensed with if so desired.

Still further, although in any one of the foregoing embodiments of the present invention, the use has been made of the low battery signal output subunit 21, the tamper signal output subunit 22, the adverse environment signal output subunit 24 and the anti-masking signal output unit 25, one or some of them may be dispensed with if so desired.

Moreover, although in any one of the foregoing embodiments of the present invention, the use has been made of the output terminal member 16 in each of the light projecting and receiving units, a plurality of output terminal members 16 may be employed one for each of outputs of such sensor signals as the object detection signal and the various abnormality detection signal.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A security sensor system which comprises a security sensor assembly including an object detecting subunit for detecting an object, a controller and a wireless transmitter for transmitting an output signal based on a signal input, and a receiver for receiving an output signal transmitted from the wireless transmitter; and in which the controller comprises an intermitted signal generating section for generating, based on a sensor signal including an abnormality detection signal, which is a signal associated with a sensor and which is detected as a result of persistence of an abnormal condition of the sensor, a sensor signal in which the sensor signal is intermitted, and is operable to perform a control of inputting the intermitted sensor signal to the wireless transmitter and then transmitting the intermitted output signal based on the signal input.

2. The security sensor system as claimed in claim 1, in which the receiver comprises a mode switching section for switching over to one of a security mode and a non-security mode;

the receiver is operable to output no warning output even when receiving the output signal transmitted from the wireless transmitter during the non-security mode, but to output the warning signal when receiving the output signal transmitted from the wireless transmitter during the security mode.

3. The security sensor system as claimed in claim 1, in which the controller also includes a transmission signal switching section for switching the sensor signal, inputted to the wireless transmitter, over to one of the intermitted sensor signal and a non-intermitted sensor signal and is operable to cause the wireless transmitter to transmit an intermitted output signal or a non-intermitted, ordinary output signal.

4. The security sensor system as claimed in claim 1, in which the security sensor has at least one battery mounted thereon and is driven by a direct current electric power and in which the abnormality detection signal includes a low battery signal detected as a result of a persistence of a low battery condition.

5. The security sensor system as claimed in claim 1, in which the security sensor is an active infrared ray sensor.

6. The security sensor system as claimed in claim 1, in which the security sensor is a passive infrared ray sensor.

* * * * *